United States Patent [19]

Weber

[11] 4,220,200

[45] Sep. 2, 1980

[54] HEAT EXCHANGER SYSTEM

[75] Inventor: Max Weber, Wiesendangen, Switzerland

[73] Assignee: Sulzer Brothers Limited, Winterthur, Switzerland

[21] Appl. No.: 846,981

[22] Filed: Oct. 31, 1977

[30] Foreign Application Priority Data

Nov. 12, 1976 [CH] Switzerland ..... 14247/76

[51] Int. Cl.[2] ..... F28D 7/12

[52] U.S. Cl. ..... 165/142; 176/60; 165/158

[58] Field of Search ..... 165/142, 145, 158; 122/34; 176/60, 87

[56] References Cited

U.S. PATENT DOCUMENTS

| | | | |
|---|---|---|---|
| 3,748,228 | 7/1973 | Zimmerman | 176/60 |
| 3,878,994 | 3/1975 | Petrek | 165/158 X |
| 4,098,329 | 7/1978 | Culver | 165/158 X |

*Primary Examiner*—Samuel Scott
*Assistant Examiner*—Theophil W. Streule, Jr.
*Attorney, Agent, or Firm*—Kenyon & Kenyon

[57] ABSTRACT

The heat exchanger system is used for gas-cooled high-temperature reactors. The high-temperature primary gas passes over a nest of blind tubes and thereafter flows over the tubes of a plurality of counter-current heat-exchangers disposed about a jacket encasing the blind tubes. The cool working gas flows into the system via a header and then passes through the tubes of the counter-current heat-exchangers before passing into the blind tubes. The working gas is exhausted via insert tubes within the blind tubes. The maximum temperatures on the heat exchanger surfaces occur at the closed ends of the blind tubes. However, these parts are substantially stress free in normal operation.

The heat exchanger system may be constructed to permit ready disassembly of the insert tubes for inspection and replacement purposes.

14 Claims, 3 Drawing Figures

HEAT EXCHANGER SYSTEM

This invention relates to a heat exchanger system and particularly to a heat exchanger system for gas-cooled high-temperature reactors.

As is known, various types of heat exchanger systems have been utilized for the gas cooling of high temperature reactors. Generally, in these cases, a high-temperature primary gas passes from a reactor core and is placed in heat exchange relation with a working gas in order to transfer heat to the working gas. The heated working gas is then used, for example, to drive thermal machines or to supply heat for a chemical process, which process may also take place in the working gas itself. In either case, the efficiency of these operations is temperature-dependent. That is, the efficiency increases with rising working gas temperature. However, higher working gas temperatures necessitate an even higher temperature in at least a part of the heat exchange structure which separates the working gas from the primary gas. As a result, this part of the structure is subjected to excessive pressures, forces and thermal stresses.

Accordingly, it is an object of the invention to provide a heat exchanger system which allows the highest possible working gas temperature without any inadmissible creep and/or fracture of the material of the heat exchanger structure.

It is another object of the invention to provide a heat exchanger system which is able to fit within the limiting conditions of a reactor plant.

Briefly, the invention provides a heat exchange system for a gas-cooled high-temperature reactor which comprises a cylindrical jacket for guiding a flow of hot primary gas, a plurality of blind tubes disposed axially within the jacket for passage of the hot primary gas thereover, a plurality of counter-current heat exchangers disposed about the jacket in parallel relation to the blind tubes and a plurality of insert tubes disposed coaxially in the blind tubes. The counter current heat exchangers are disposed in communication with the flow of primary gas for passage of the primary gas thereover. In addition, each heat exchanger has a means for passage of a flow of working gas in counter-current to the primary gas. The insert tubes are each in communication with this latter means of the heat exchangers and also define annular gaps with the blind tubes for passage of the working gas from the heat exchangers to the interior of the insert tubes.

The heat exchange system permits a maximum temperature to occur within the system without incurring any inadmissable creep and/or fracture of the material of the structure. In addition, the heat exchange system can be assembled on a building site in a relatively easy manner, and with relatively few welds, from large prefabricated and easily transportable elements. Further, the system allows the use of thin wall thicknesses and insignificant accumulation of material particularly in those zones where the maximum temperatures arise. By using thin wall thicknesses, there is a low consumption of expensive material while the insignificant material accumulation results in lower thermal stresses and permits rapid temperature variations.

These and other objects and advantages of the invention will become more apparent from the following detailed description and accompanying drawings in which.

Figure 1:
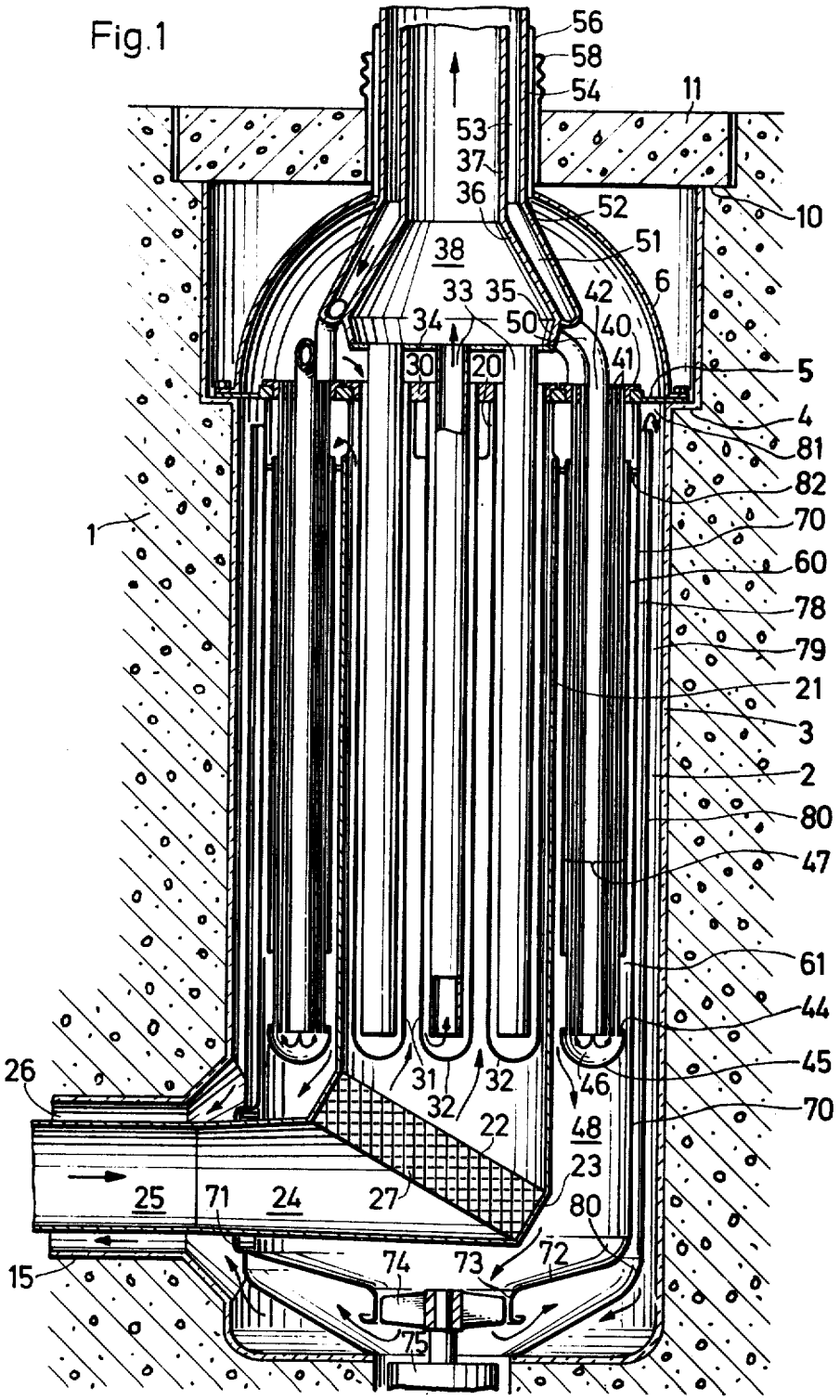
FIG. 1 illustrates a vertical sectional view of a heat exchange system disposed in a concrete pressure vessel in accordance with the invention.

Referring to FIG. 1, a concrete pressure vessel 1 has a centrally disposed reactor core (not shown) and a number of substantially circular cylindrical chambers 2 (only one of which is shown) which are disposed peripherally on vertical axes. Each chamber 2 is lined with an insulation 3 covered with sheet-metal. At the top, each cylindrical chamber 2 is provided with two steps 4, 10. A supporting grid 5 and a flange ring of a dome 6 rest on the bottom step 4 while a concrete reinforced cover 11 rests on the top step 10, being retained by a suitable means (not shown). The cylindrical chamber 2 is connected via a horizontal duct 15 to a chamber housing the reactor core (not shown).

A cylindrical jacket 21 is suspended from a number of narrow webs 20 on the supporting grid 5 and, at the bottom, abuts a short cylinder 23 of elliptical cross-section at an angle in a plane 22. The cylinder 23, in turn, is connected via a substantially conical transition member 24 to a primary gas supply pipe 25. An annular passage 26 is formed between the primary gas supply pipe 25 and the wall of the duct 15.

A static mixer 27 is disposed in the space of the short elliptical cylinder 23 and consists, for example, of a system of graphite rods disposed crosswise, at an angle of 45° to the direction of flow of the primary gas.

The cylindrical jacket 21, the short cylinder 23, the transition member 24 and the primary gas supply pipe 25 consist of high-temperature resistant metal sheets thermally insulated.

The supporting grid 5 has a circular cut-out at the center and a number of smaller circular cut-outs arranged peripherally around the center cut-out. A tube plate 30 provided with a flange fits in the central cut-out and a nest of bayonet sheathing or blind tubes 31 (e.g. seven) terminates therein. Each of the tubes 31 is closed at the bottom by a spherical dome 32. In addition, insert tubes 33 are coaxially disposed in the tubes 31 and are suspended from a tube plate 34 at the top and terminate as open tubes at the bottom in the region of the dome 32. Two conical members 35, 36 are connected at the top to the tube plate 34, as is also a working gas outlet 37. The members 35, 36 which form a header 38 for the working gas, and the pipe 37, consist of high-temperature resistant sheet-metal, which is also lined with a thermal insulation, e.g. a ceramic insulation.

A tube plate 40 provided with a flange fits in each of the peripheral cut-outs of the supporting grid 5 and hollow members, such as elongate tubes 41, are disposed in an annular zone therein around a central tube 42. The bottom ends of the tubes 41 and of the central tube 42 terminate in a tube plate 44 enclosed at the bottom by a dome 45 to form a distributor 46. The tube plates 40 containing the tubes 41 and the distributors 46 form counter-current heat-exchangers 47 projecting into an annular space 48 bounded on the inside by the jacket 21.

The tube 42 of each heat exchanger 47 is connected to a conical annular space 51 by way of a connecting branch pipe 50 which extends tangentially at an angle. The annular space 51 extends between the conical member 36 and a cone 52 and merges at the top into a cylindrical annular space 53 between the working gas outlet pipe 37 and a pipe 54. A sleeve 56 is connected in sealing-tight relationship to the pipe 54 above the cover 11 and in sealing-tight relationship to the dome 6 below the cover 11. A corrugated tube 58 is connected to the sleeve 56 and the cover 11 so as to make the vessel 1 gas-tight.

Each of the nests of tubes 41 of the peripheral counter-current heat-exchangers 47 is enclosed by an encasing tube 60 suspended from the tubes 41. These tubes 60 terminate at the top flush with the cylindrical jacket 21 and at the bottom leave free a flow cross-section 61 above the distributors 46.

A cylindrical shell 70 is welded to the underside of the supporting grid 5 outside the bores for the tube plates 40 and has a lateral opening 71 in the bottom zone for the passage of the transition member 24. This shell 70 also has a curved end 72 with an axial aperture 73 in which a rotor 74 of a blower driven by a vertical-axis motor 75 is mounted. As shown, the intake side of the blower is in communication with the heat exchangers 47 at an end opposite the grid 5. A cylindrical baffle 80 forming two split chambers 78, 79 is provided in the annular space between the shell 70 and the insulation 3. At the top the baffle 80 leaves free a passage aperture 81 while, at the bottom, the baffle 80 is welded in gas-tight relationship to the end of the cylindrical chamber 2 and to the outside of the opening 71.

That part of the annular chamber 48 which is situated between the jacket 21 and the encasing tubes 60 is sealed off by bulkheads 82 fixed to the jacket 21 and to the shell 70.

In operation, hot primary gas flows through the primary gas supply pipe 25, transition member 24, and the static mixer 27—in which the temperature of the primary gas is equalized—longitudinally around the tubes 31, at which heat is given up. The primary gas then flows through the slots between the webs 20 into the spaces between the tubes 41. While flowing around the tubes 41, the primary gas flows through the encasing tubes 60 and, after flowing around the distributors 46, reaches the blower 74. The blower 74 delivers the cooled primary gas into the split chamber 78 between the shell 70 and the baffle 80, through which the gas rises to the top edge of the baffle 80. From there, the primary gas flows in the split chamber 79 between the baffle 80 and the insulation 3 down to the end of the cylindrical chamber 2, from which the gas flows back to the reactor chamber via the annular duct 26 between the primary gas supply pipe 25 and the duct 15.

A working gas flows through the annular space 53 and the conical annular space 51 and the resiliently arranged connecting tubes 50 and the central tubes 42, into the distributors 46 and then through the tubes 41—in which heating up occurs in counter-current to the primary gas—into the hemi-spherical space beneath the dome 6. From this space, the working gas flows through the annular gaps between the blind tubes 31 and the insert tubes 33 to the closed end 32 of the tubes 31, being heated to a maximum temperature. Thereafter, the working gas reverses and flows through the tubes 33—which have insulation on the inside—via the outlet pipe 37, to the load, e.g. a gas turbine group or a chemical plant.

The above arrangement means that the maximum temperatures on the heat-exchanger surfaces occur at the domes 32 and in the bottom zones of the tubes 31. These parts are substantially stress-free in normal operation, so that high working gas end temperatures are permissible.

On entry to the counter-current heat exchangers 47, the temperature of the primary gas has already dropped to such an extent that the metal temperatures occurring are still admissible, even with the considerable stresses permanently expected there.

Spacers may be provided on the insert tubes 33 to center the tubes 33 in the blind tubes 31, perferably at a distance from the tube plates 34 equivalent to about two-thirds of the length of the insert tubes 33.

The exemplified embodiment shown in the drawing is to be regarded only as a diagram inasmuch as, for example, it is possible to provide not just seven but, for example, a hundred blind tubes 31 terminating in the same tube plate 30.

Figure 2:
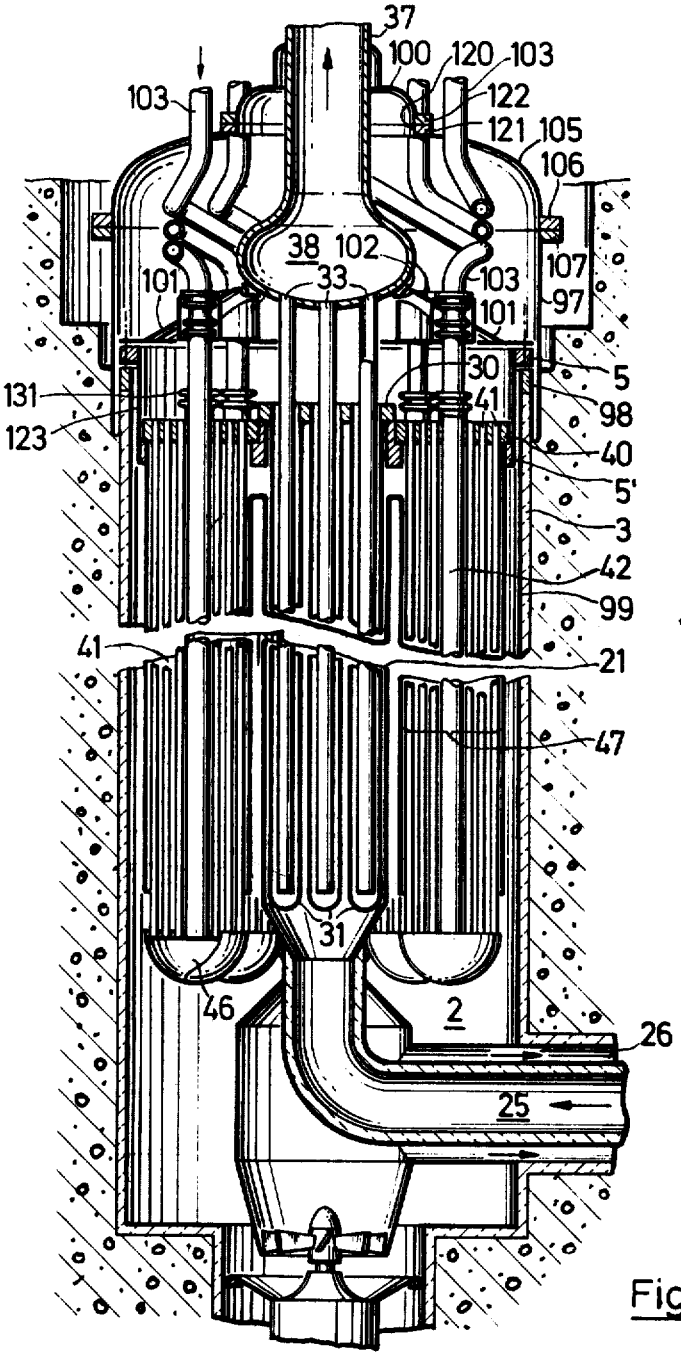
FIG. 2 illustrates a vertical sectional view through a modified heat exchange system in accordance with the invention.

If the blind tubes 31 have to undergo inspection or testing, the exemplified embodiment according to FIG. 2 enables this to be carried out with relatively little dismantling.

Referring to FIG. 2, wherein like reference characters indicate like parts as above, the supporting grid 5 does not rest on a step of the concrete pressure vessel, but on a sheet-metal lining 99 of the chamber 2. A solid ring 98 is fixed to the top end of the lining 99 and receives bolts (not shown) to fix the supporting grid 5. A metal sheet 97 is connected to the outside of the solid ring 98 and extends first downwardly and encloses a part of the thermal insulation 3, and then extends upwardly and terminates at a flange 107, on which rests a flange 106 of a dome 105. This dome 105 covers the entire heat-exchanger system and has an aperture 120 at the center. This aperture 120 is closed by a detachable cover 100. The connection between the cover 100 and the dome 105 is made by set screws (not shown) which fit in a flange 121 fixed on the dome 105 about the aperture 120 and extend through a flange 122 provided on the cover 100.

Unlike the example shown in FIG. 1, the supporting grid 5 does not extend in one plane, but over two different planes, since one portion 5' of the supporting grid receiving the tube plates 30, 40 is connected via a tube 123 to a part of the supporting grid which rests on the solid ring 98.

The insert tubes 33 are connected by their top ends to a pear-shaped header 38, to which a pipe 37 is connected at the top to exhaust the hot working gas. This pipe 37 extends through the cover 100 and is connected thereto in sealing-tight relationship. The aperature 120 in the dome 105 is made such that when the bolts connecting the flanges 121, 122 have been released, the cover 100 and the header 38 with the insert tubes 33 connected thereto can be removed through the aperture 120. A number of pipes 103 extend through the dome 105 outside the flanges 121, 122 and supply the cold working gas to the counter-current heat-exhangers 47.

Figure 3:
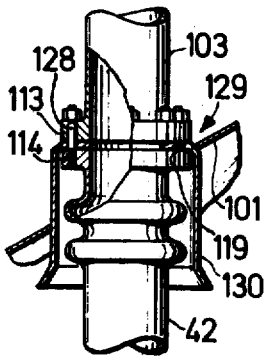
FIG. 3 illustrates a detail of the heat exchange system of FIG. 2 to a larger scale.

A dish 101 is fixed on the supporting grid 5 to cover the same, by means of screws (not shown) provided at the outer edge of the dish and disposed in the grid 5. The dish 101 is in the form of a shallow hollow truncated cone, the top edge 102 of which bears resiliently and in sealing-tight relationship against the header 38. A detachable flange connection 129 (shown on an enlarged scale in FIG. 3) is provided at each of the places where the pipes 103 communicate or connect with the central tubes 42 leading to the distributors 46. As shown, the flange connection 129 consists of a flange 113 provided on the pipe 103 and a flange 114 provided on the central tube 42. Set screws 128 extend through the flanges 113, 114 to secure the flanges 113, 114 together. The dish 101 is held between these flanges, having a sleeve 103 in each passage zone, the top end of the sleeve 130 being constructed as a radial collar 119 clamped between the flanges 113, 114. The central tube 42 is constructed as a corrugated bellows beneath the flange 114 to take differential expansion. Each tube 42 also has a corrugated bellows 131 fixed at one end to the tube plate 40 and at the other end to the central tube 42.

After the screws connecting the flanges 121, 122 have been released, the cover 100 together with the pipe 37 and the header 38 can be removed from the heat-exchanger system. The insert tubes 33 are also removed when the header 38 is removed, so that test equipment can be introduced through aperture 120 into the tubes 31 to enable testing to be carried out.

If the tubes 41 of the counter-current heat-exchangers 47 are also to be inspected, the screw connections of the flanges 106, 107 of the dome 105 and the screw connection of flanges 113, 114 are also released. The dome 105 together with the supply pipes 103 can then be removed. The connecting screws at the outer edge of the dish 101 are then released, whereupon the dish 101 can be lifted from the grid 5, so that the interior of the tubes 41 and the central tubes 42 are exposed for testing purposes.

What is claimed is:

1. A heat exchange system for a gas-cooled high-temperature reactor comprising a cylindrical jacket for guiding a flow of hot primary gas longitudinally therethrough;

a plurality of blind tubes disposed axially within said jacket for passage of the hot primary gas thereover;

a plurality of counter-current heat exchangers disposed about said jacket in parallel relation to said blind tubes and in communication with the flow of primary gas for passage of the primary gas thereover, each said heat exchanger having means therein for passage of a flow of working gas in counter-current to the primary gas; and a plurality of insert tubes in communication with said means of said heat exchangers, each said insert tube being disposed coaxially in a respective blind tube to define an annular gap for passage of a working gas therethrough from said heat exchanger means to the interior of said respective insert tube.

2. A heat exchange system as set forth in claim 1 which further comprises a first tube plate having said blind tubes mounted therein, a second tube plate having said heat exchangers mounted therein and a common supporting grid having said tube plates fixed thereto in seal-tight relation.

3. A heat exchange system as set forth in claim 2 which further comprises a spherical dome covering said grid, and at least one header disposed in said dome with said insert tubes terminating in said header.

4. A heat exchange system as set forth in claim 1 wherein said means of each said heat exchanger includes a plurality of elongate hollow tubes, and wherein each heat exchanger further includes an encasing tube disposed about said hollow tubes and open at opposite ends to guide the primary gas over said hollow tubes, and a plurality of bulkheads on an exterior surface of said encasing tube for sealing off said exterior surface to a longitudinal flow of the primary gas.

5. A heat exchange system as set forth in claim 4 which further comprises at least one annular chamber surrounding said heat exchangers for a through-flow of a cooled primary gas.

6. A heat exchange system as set forth in claim 5 which further comprises a grid supporting said heat exchangers thereon and a blower having an intake side in communication with said heat exchangers at an end opposite said grid.

7. A heat exchange system as set forth in claim 6 wherein said blower has a delivery side in communication with said annular chamber.

8. A heat exchange system as set forth in claim 7 which further comprises a supply pipe for supplying a flow of hot primary gas to said jacket, a second annular chamber about and in communication with said one annular chamber, and a annular duct communicating with an outlet end of said second annular chamber and disposed about said supply pipe.

9. A heat exchange system as set forth in claim 1 which further comprises a static mixer upstream of said jacket in the flow of hot primary gas.

10. A heat exchange system as set forth in claim 1 which further comprises a header connected to said insert tubes to receive the working gas therefrom, a first pipe extending from said header to exhaust the working gas therefrom, a second pipe surrounding said first pipe and at least a part of said header in spaced relation to deliver a flow of cold working gas, and a plurality of branch pipes, each said branch pipe extending from said second pipe to a respective one of said heat exchangers to deliver the working gas thereto.

11. A heat exchange system as set forth in claim 10 wherein each heat exchanger includes a plurality of parallel elongate hollow tubes, a pair of tube plates secured at respective ends of said hollow tubes, a central tube extending through said tube plates and a distributor secured to one of said tube plates; each said branch pipe extending to a respective central tube.

12. A heat exchange system as set forth in claim 1 which further comprises a pressure vessel encasing said jacket and said heat exchangers.

13. A heat exchange system as set forth in claim 1 which further comprises a header secured to said insert pipes; a pipe extending from said header to exhaust the working gas therefrom; a first tube plate having said blind tubes mounted therein; a second tube plate having said heat exchangers mounted therein; a common grid having said plates fixed thereon in seal-tight relation; a dome covering said grid and said plates, said dome having a central aperture therein with said pipe passing therethrough, said aperture being sized to permit removal of said header and said insert pipes therethrough; a cover sealingly connected between said pipe and said dome to cover said aperture; and a dish within said dome, said dish being mounted on said grid to cover said grid and being resiliently disposed against said header in seal-tight relation.

14. A heat exchange system as set forth in claim 13 wherein each heat exchanger has a branch pipe extending therethrough to conduct a flow of working gas into said heat exchanger and which further comprises a plurality of delivery pipes for delivering cold working gas to said heat exchangers, each said delivery pipe extending to said dish and being in communication with a respective branch pipe, each said delivery pipe and branch pipe having an opposed flange on opposite sides of said dish and means securing said opposed flanges together.

* * * * *